US008813510B2

(12) United States Patent
Resch

(10) Patent No.: US 8,813,510 B2
(45) Date of Patent: Aug. 26, 2014

(54) FREEZER

(75) Inventor: Reinhold Resch, St. Peter (AT)

(73) Assignee: AHT Cooling Systems GmbH, Rottenmann (AT)

( * ) Notice: Subject to any disclaimer, the term of this patent is extended or adjusted under 35 U.S.C. 154(b) by 0 days.

(21) Appl. No.: 13/576,759

(22) PCT Filed: Feb. 7, 2011

(86) PCT No.: PCT/AT2011/000069

§ 371 (c)(1),
(2), (4) Date: Aug. 2, 2012

(87) PCT Pub. No.: WO2011/094792

PCT Pub. Date: Aug. 11, 2011

(65) Prior Publication Data

US 2012/0297810 A1 Nov. 29, 2012

(30) Foreign Application Priority Data

Feb. 5, 2010 (DE) ..... 10 2010 007 141

(51) Int. Cl.
*F25D 21/14* (2006.01)
*F25D 21/00* (2006.01)

(52) U.S. Cl.
USPC ..... 62/150; 62/285

(58) Field of Classification Search
USPC ..... 62/275, 150, 285
See application file for complete search history.

(56) References Cited

U.S. PATENT DOCUMENTS 1,141,188 A * 6/1915 Johnson ..... 52/220.1
2,180,071 A * 11/1939 Smith ..... 62/288
2,479,135 A * 8/1949 Rutishauser ..... 62/249
2,807,942 A * 10/1957 Dahlgren ..... 62/130
2,867,095 A * 1/1959 Robbie ..... 62/285
2,937,511 A * 5/1960 Mann ..... 62/198
3,180,100 A * 4/1965 Newton ..... 62/3.4
3,182,467 A * 5/1965 Beckwith ..... 62/256
3,218,822 A * 11/1965 Bently et al. ..... 62/256
3,224,216 A * 12/1965 Crouch ..... 62/140
3,425,236 A * 2/1969 Nolin et al. ..... 62/140

(Continued)

FOREIGN PATENT DOCUMENTS

AU 6102680 A 2/1981
DE 2217752 A1 10/1973

(Continued)

OTHER PUBLICATIONS

Response filed in EPO for Registration No. 11708973-1266 PCT/AT 2011/000069, Mar. 19, 2013.

*Primary Examiner* — Ljiljana Ciric
*Assistant Examiner* — Alexis Cox
(74) *Attorney, Agent, or Firm* — Donald J. Ranft; Collen IP

(57) ABSTRACT

A freezer with an outer and inner housing, wherein the inner housing has a cooling space and a trough-shaped configuration on its bottom. There is a channel in the trough-shaped configuration to capture dew water and/or condensation water. A refrigerant circuit including a compressor and evaporator lines is operably connected to the cooling space of the inner housing. The evaporator lines of the refrigerant circuit run around the cooling space and are attached to at least one sidewall of the inner housing. The evaporator lines are located in the space between the inner and outer housing with the lowermost evaporation line adjacent to the lowermost portion of the channel.

7 Claims, 5 Drawing Sheets

(56) References Cited

U.S. PATENT DOCUMENTS

| | | | | |
|---|---|---|---|---|
| 4,916,919 | A * | 4/1990 | Kim | 62/272 |
| 5,842,355 | A * | 12/1998 | Kalis et al. | 62/234 |
| 2007/0012050 | A1* | 1/2007 | Brown | 62/50.2 |
| 2007/0169498 | A1* | 7/2007 | Rios | 62/285 |
| 2009/0217688 | A1* | 9/2009 | Resch | 62/234 |

FOREIGN PATENT DOCUMENTS

| | | | |
|---|---|---|---|
| FR | 1402473 | A | 6/1965 |
| FR | 1432348 | A | 3/1966 |
| JP | 47007765 | U | 9/1972 |
| WO | 2006/130886 | A1 | 12/2006 |

* cited by examiner

FREEZER

The invention relates to a cooling device, in particular a freezer, according to the preamble of patent claim 1.

A cooling device for frozen products is already known from WO 2006/130886. The known cooling device has a control apparatus which is provided for deicing and which cooperates with a refrigerant circuit in such a way that, during deicing, both the evaporator and a run-off channel provided for receiving the dew water are warmed. The run-off channel is arranged below the evaporator.

The object on which the invention is based is to design a cooling device of the type mentioned in the introduction in such a way that deicing is improved.

The invention achieves this object in that, in the cooling device, in which evaporator lines are arranged vertically with respect to one another and in which a run-off channel for the capture of dew water and/or condensation water is provided, the lowermost evaporator line is arranged essentially at the same height as the run-off channel.

This relative arrangement of the evaporator and run-off channel increases the efficiency of the deicing operation and is distinguished by a comparatively lower energy consumption.

Further advantageous embodiments of the invention are defined in the subclaims.

The subject of the invention is illustrated by means of two exemplary embodiments in the figures in which.

Figure 1:
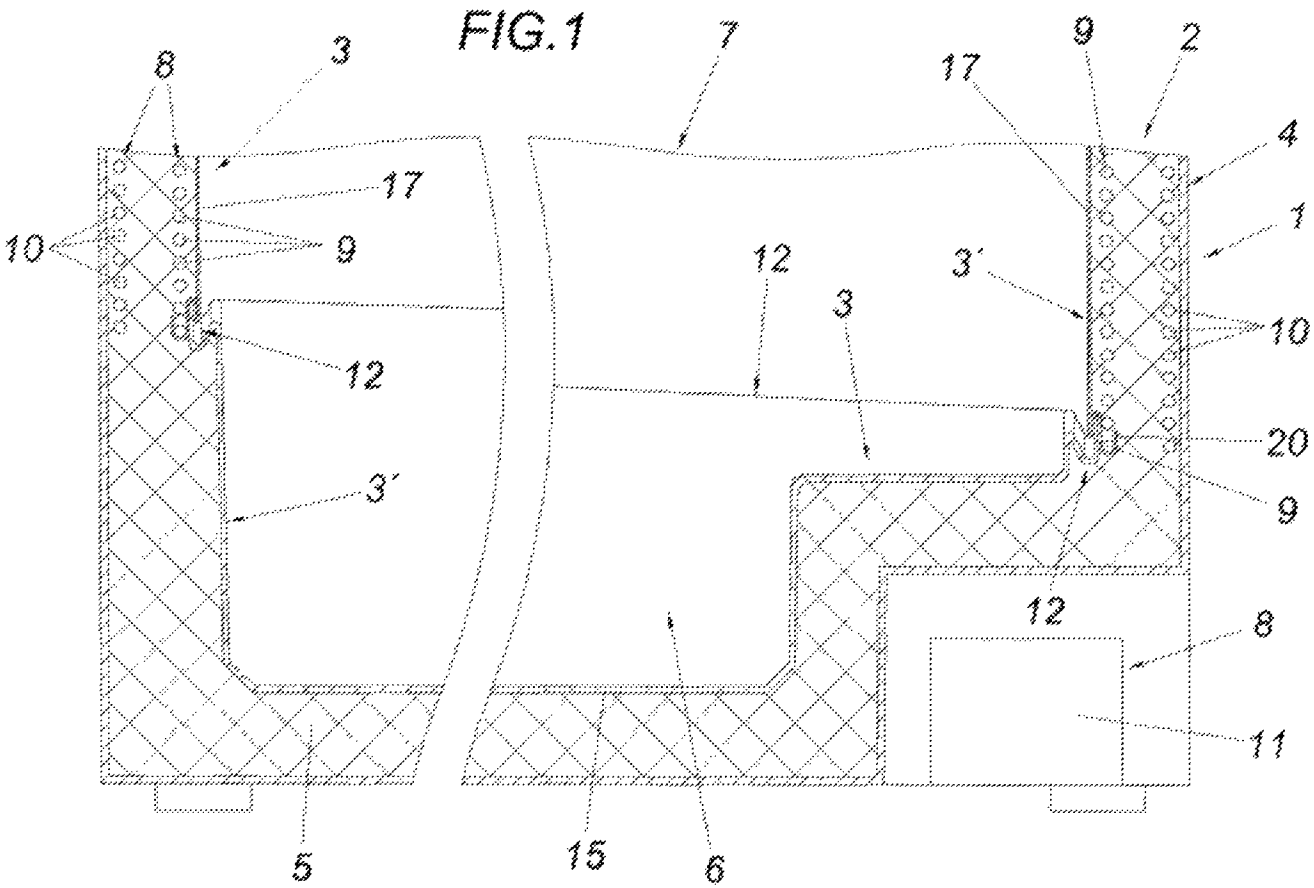
FIG. 1 shows a sectional side view of part of a first freezer.

The first freezer 1, illustrated partially, by way of example, according to FIG. 1, has a housing 2. The housing 2 is composed essentially of a multipart inner housing 3 and of an outer housing 4, between which foam 5 is introduced.

The inner housing 3 is composed of a deep-drawn trough, including a run-off channel 12, made from a plurality of metal sheets which adjoin the channel 12, have a plug-in configuration and overlap one another. The inner housing has a trough-shaped configuration and forms a cooling space 6 for products, not illustrated in any more detail, which are to be cooled. For the purpose of access to the cooling space 6, the housing 2 forms a housing orifice 7 which is accessible from above and which is closed by means of a lid, not illustrated in any more detail.

To act with cold upon the cooling space 6, an apparatus 8 is provided, which acts thermally upon the cooling space 6 via part of the sidewall 3' of the inner housing 3.

For this purpose, the apparatus 8 has an evaporator 9 which is incorporated in a refrigerant circuit, not illustrated in any more detail, with a condenser 10 and with a compressor 11.

Figure 3:
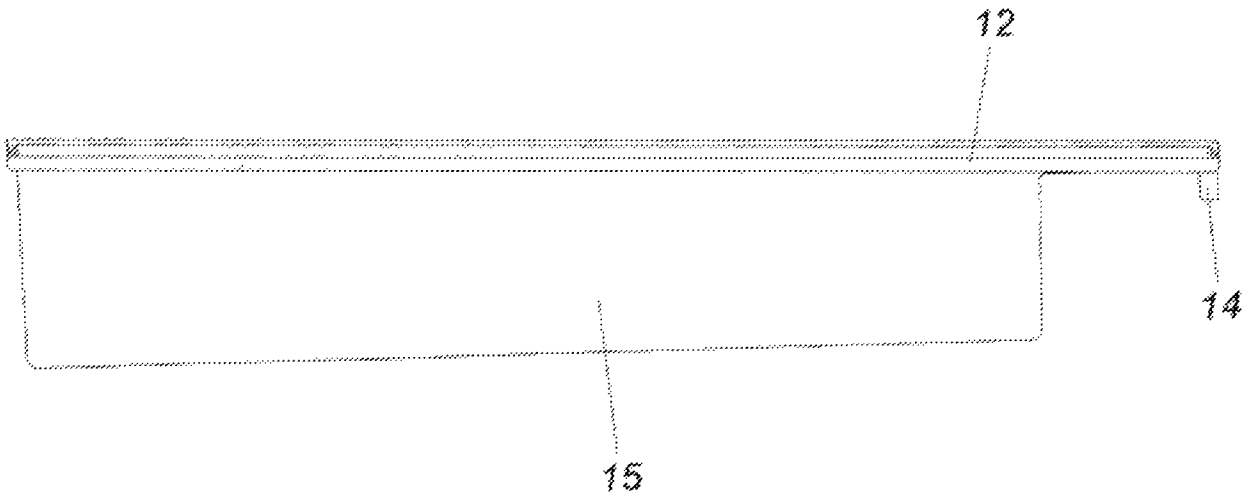
FIG. 3 shows a side view of the trough part of the inner housing of the freezer.
Figure 4:
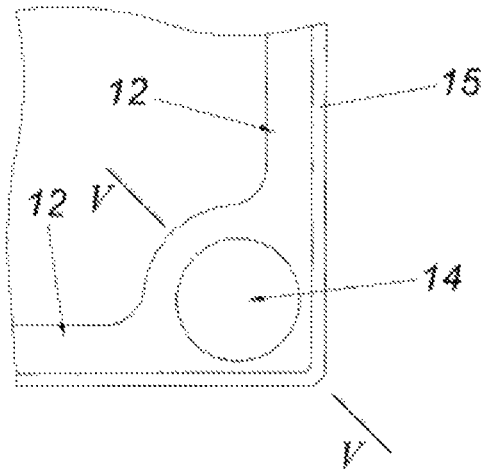
FIG. 4 shows a cut-away top view of the outflow of the trough part according to FIG. 3.
Figure 5:
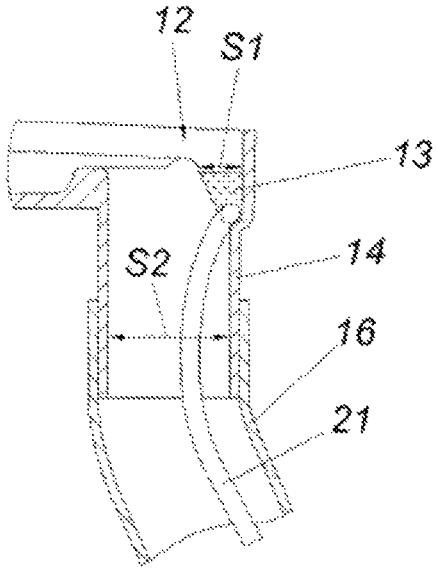
FIG. 5 shows a sectional side view according to V-V of FIG. 4.

Near the sidewalls 3' of the inner housing 3, the run-off channel 12 is provided, which discharges dew water during the defrosting of ice formations on the inner housing 3. This channel 12 runs along the cooled sidewalls 3' of the inner housing 3, all the sidewalls 3' of the inner housing 3 being cooled partially by the apparatus 8, so that the channel 12 is of continuous form. The inclination of the channel 12 is selected in such a way that the captured water is conducted to an outflow 14, as illustrated in FIG. 3.

In order, then, to ensure that the freezer 1 has a special stability, there is provision whereby the multipart inner housing 3 has a one-piece trough part 15, the trough part 15 also forming the channel 12. The channel 12 is therefore part of the one-piece trough part 15, with the result that joint edges and therefore possible leaks are avoided even in the case of comparatively high temperature differences. According to the invention, therefore, rapid defrosting can also be carried out in a freezer 1 for low-temperature refrigeration, to be precise because comparatively high heating powers (in the region of about 75 watt and with a maximum compressor power in the defrosting cycle of up to about 750 watt) can be applied to the sidewalls 3 which are composed, for example, of sterilized aluminum sheets. Moreover, such a structural set-up of a trough can be produced comparatively simply by deep drawing or injection molding, and therefore the freezer can be produced comparatively cost-effectively.

The outflow 14 follows, widening at least partially with respect to the flow diameter S1 of the channel 12. The flow diameter S2 of the outflow 14 is therefore larger than the flow diameter S1 of the channel 12. Moreover, the outflow 14 is formed by the one-piece trough part 15. A hose 16 is plugged onto the outflow 14 in order to discharge the dew water 13 further on.

The apparatus 8 is designed, on the one hand, for cooling the cooling space 6 and, on the other hand, for defrosting the sidewalls of the inner housing, in that the direction of the refrigerant circuit is reversed. Thus, the evaporator 9 is used in a structurally simple way, on the one hand, for cooling the cooling space 6 and, on the other hand, also for defrosting the sidewalls of the inner housing 3.

Figure 2:
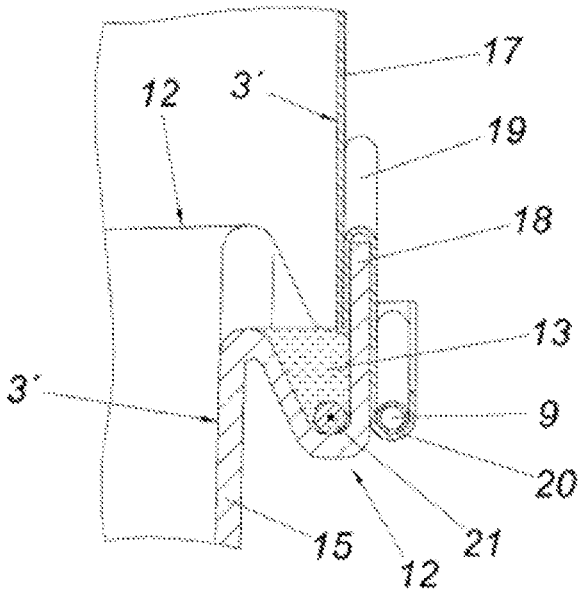
FIG. 2 shows an enlarged part view of the channel according to FIG. 1.

Those parts of the sidewalls of the inner housing 3 which are acted upon thermally by the apparatus 8 are arranged essentially above the channel 12, so that essentially the entire dew water 13 can consequently be received, as illustrated in FIG. 2.

However, one of a plurality of evaporator lines 9, in particular the lowermost evaporator line, is arranged essentially at the same height as the channel 12.

The above-described inner housing parts 17 of the inner housing 3 adjoin the channel 12 of the trough part 14 in a structurally simplified way. This is made possible in a simple way in that a U-shaped attachment clip 19 of the inner housing part 17 is plugged on at the channel end 18 running out. As shown on FIGS. 1 and 3 this results in the lowermost evaporator line being horizontally adjacent to the channel 12.

The apparatus 8 acts with a predetermined temperature upon the cooling space 6 with the aid of evaporator lines 9 running around the cooling space. These evaporator lines 9 are arranged vertically with respect to one another and so as to bear against the sidewalls of the inner housing 3; condenser coils 10 of the apparatus 8 are provided on the outer housing 4.

Simple structural conditions arise when, to position the first (here, lowermost) evaporator line 9, at least one side sheet 17 adjoining the trough part 15 has an extension 20 into which the lowermost evaporator line 9 is introduced.

Furthermore, the channel 12 has an electrical (additional) heating apparatus 21, by means of which, for defrosting purposes, the channel 12 is warmed or any captured water 13 is discharged having been warmed, with the result that the possible formation of ice is also avoided. The lowermost evaporator line 9 is arranged essentially at the same height as the lowermost portion of the channel 12 in which, in turn, the electrical heating apparatus 21 is arranged. Thus both the lowermost evaporator line 9 and the electrical heaters apparatus 21 are essentially the same height/distance above the bottom of the freezer.

Consequently, the lowermost evaporator line 9, the channel 12 and the electrical heating apparatus 21 are located essentially at the same height in the cooling device. Advantageously, in addition to the heat generated by the evaporator (here, lowermost evaporator line 9), heat is also generated by the heating apparatus 21.

The electrical heating apparatus 21 may be activated and deactivated manually or automatically.

For this automatic activation and deactivation of the heating apparatus 21 (hereinafter, "RH"), the cooling device has an electrical control apparatus, not illustrated in the figures, which is connected to the compressor 11 and the heating apparatus 21.

This electrical control apparatus may also be connected to a solenoid closing valve. The closing valve, which is described, for example, in Austrian utility model AT 008 789 U1, lies in a bypass line, parallel to the condenser and throttle. After the opening of the closing valve, hot refrigerant gas compressed by the compressor can be used directly for warming the evaporator.

The electrical control apparatus is assigned a control program which defines a defrosting cycle which, for example, is configured as follows and comprises the following work phases:

1. Normal operation (cooling operation) Speed of the compressor (11, hereinafter, "K"): the rotational speed as required or according to control behavior, for example between 2000 and 4000 rpm
2. Heating run-up time (0 to 99 minutes)
   Solenoid valve (hereinafter, "MV"): off
   RH: on
   K: off
3. Defrost safety time (0 to 99 minutes)
   MV: on
   RH: on
   K: on (for example, 90% of maximum rotational speed)
4. Standstill time: (fixed time)
   MV: off
   RH: on
   K: off (rotational speed: 0 rpm)
5. Heating run-down time (time: 0 to 99 minutes, start of cooling operation)
   MV: off
   RH: on
   K: on (rotational speed: for example, maximum rotational speed)

The compressor 11 is then first maintained at maximum rotational speed and is subsequently switched to normal operation (work phase 1) again.

Figure 6:
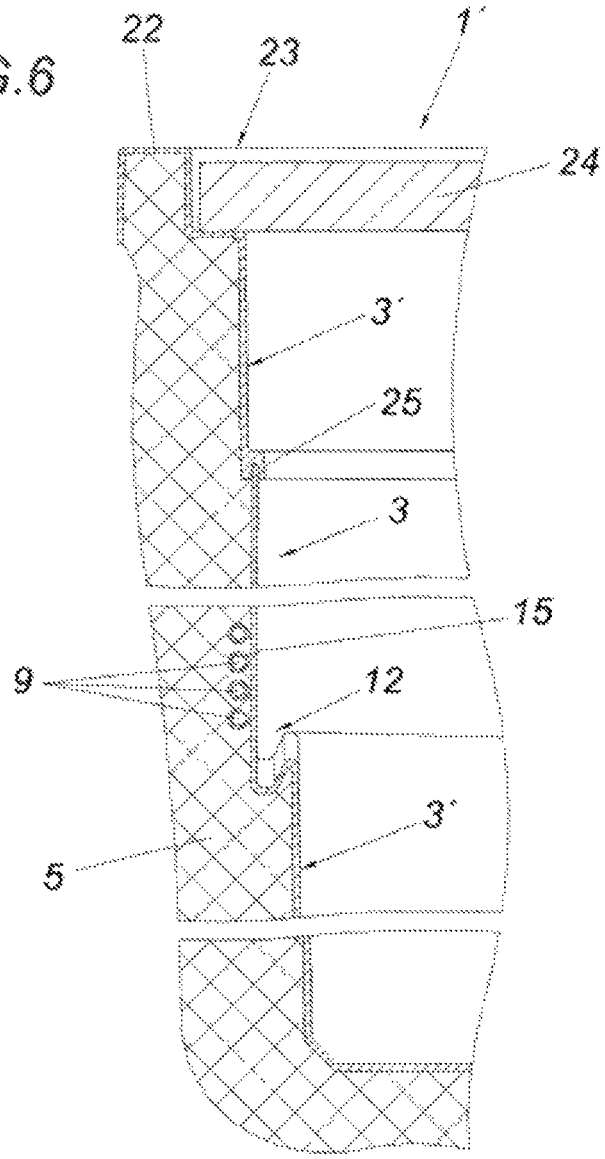
FIG. 6 shows a sectional side view of part of a second freezer.

The freezer 1' illustrated according to FIG. 6 differs from the freezer 1 according to FIG. 1 in that, in comparison with this, the trough part 15 is drawn further up so that it can be connected to a frame 22. The frame 22 likewise serves partially as a sidewall 3' of the inner housing 3, the frame 22 also having guides 23 for a lid 24 of the freezer 1' and being plugged on the trough part 15. For the latter purpose, the frame 22 forms a plug groove 25 into which the trough part 15 projects.

REFERENCE SYMBOLS

1, 1' Freezer
2 Housing
3 Inner housing
3' Sidewall
4 Outer housing
5 Foam
6 Cooling space
7 Housing orifice
8 Apparatus
9 Evaporator
10 Condenser
11 Compressor
12 Channel
13 Dew water
14 Outflow
15 Trough part
16 Hose
17 Inner housing parts
18 Channel end
19 Attachment clip
20 Extension
21 Electrical heating apparatus
22 Frame
23 Guides
24 Lid
25 Plug groove

I claim:

1. A cooling device comprising:
an outer housing;
an inner housing surrounding a cooling space;
a trough shaped configuration formed on a lower portion of the inner housing;
a refrigerant circuit including evaporator lines and a compressor, wherein the refrigerant circuit is operably connected to the cooling space;
the evaporator lines located in the space between the outer housing and the inner housing with each evaporator line bearing on the sidewall of the inner housing;
a channel formed into the trough shaped configuration on the lower portion of the inner housing; and
a lowermost evaporator line of the evaporator lines located horizontally adjacent to a lowermost portion of the channel at the same height above a bottom of the cooling device.

2. The cooling device as claimed in claim 1 further comprising an electrical heating apparatus is located in the lowermost portion of the channel.

3. The cooling device as claimed in claim 2, wherein the electrical heating apparatus can be activated manually.

4. The cooling device according to claim 2 wherein the electrical heating apparatus is activated automatically.

5. The cooling device according to claim 2 further comprising an electrical control apparatus for controlling the compressor and the electrical heating apparatus.

6. The cooling device according to claim 2 further comprising a valve in a bypass line parallel to the compressor.

7. The cooling device according to claim 6 further comprising an electrical control apparatus for controlling the compressor, the electrical heating apparatus, and the valve in the bypass line.

* * * * *